US006874427B2

(12) United States Patent
Izumi

(10) Patent No.: US 6,874,427 B2
(45) Date of Patent: Apr. 5, 2005

(54) OUTDOOR TABLE AND CHAIR SET

(75) Inventor: Satoshi Izumi, Tokyo (JP)

(73) Assignee: On Way Co., Ltd., Tokyo (JP)

( * ) Notice: Subject to any disclaimer, the term of this patent is extended or adjusted under 35 U.S.C. 154(b) by 99 days.

(21) Appl. No.: 10/325,654

(22) Filed: Dec. 20, 2002

(65) Prior Publication Data

US 2004/0003761 A1 Jan. 8, 2004

(30) Foreign Application Priority Data

Jul. 5, 2002 (JP) ..... 2002-197526

(51) Int. Cl.[7] ..... A47B 3/00
(52) U.S. Cl. ..... 108/34; 297/17
(58) Field of Search ..... 108/34, 38, 36, 108/33, 128, 41, 35; 297/17, 139

(56) References Cited

U.S. PATENT DOCUMENTS 1,295,194 A * 2/1919 Parelius ..... 108/34
1,457,041 A * 5/1923 Orear ..... 297/139
1,622,327 A * 3/1927 Livingood ..... 297/139
2,023,870 A * 12/1935 Casott ..... 108/34
2,109,869 A * 3/1938 Ross ..... 297/143
2,279,122 A * 4/1942 Kovalchuk ..... 108/35
2,358,883 A * 9/1944 Rothschild ..... 108/35
2,457,411 A * 12/1948 Steinberger ..... 297/139
2,535,921 A * 12/1950 Hart ..... 108/34
3,387,572 A * 6/1968 Ulrich ..... 108/34
6,026,751 A * 2/2000 Tsai ..... 108/34
6,109,687 A * 8/2000 Nye et al. ..... 297/139
6,234,089 B1 * 5/2001 Zheng et al. ..... 108/115

* cited by examiner

*Primary Examiner*—Jose V. Chen
(74) *Attorney, Agent, or Firm*—Katten Muchin Zavis Rosenman

(57) ABSTRACT

An outdoor table comprising a tabletop slat members connected to each other to be deployed and folded, a pair of table-leg assemblies spaced apart from each other in a longitudinal direction of the slat members and each mounted to two of the slat members at the center in the deploying and folding direction and adapted to be folded underneath the tabletop, two pair of bars connected to the two slat members at a location near the ends of the slat members such that each pair of bars can be rotated in opposite directions around the location between a state where the bars are directed almost in parallel to the slat members in its lengthwise direction and a state where the bars are directed orthogonal to the slat members, joint members provided on two of the slat members located at the opposite ends of the tabletop such that the joint members are located near the opposite ends of the two slat members on the lower surface, and engagement structures provided on the outside ends of the bars so as to be engaged with the joint members of the slat members.

17 Claims, 17 Drawing Sheets

OUTDOOR TABLE AND CHAIR SET

BACKGROUND OF THE INVENTION

1. Field of the Invention

This invention relates to an outdoor table and chair set, and more particularly to a portable outdoor table and chair set that can be assembled and can be folded up together.

2. Description of the Related Art

There is a demand for an outdoor table that is compact, lightweight, portable and easy to assemble for use in outdoor activities or outdoor work. Proposed and put into use in order to meet this demand are outdoor tables that are constructed such that the legs and tabletop can be separated and that the separated legs and tabletop can be folded up, or outdoor tables that have folding legs installed underneath the tabletop.

However, when installing a reinforcement mechanism, such as a link mechanism between the four legs, to obtain strength, there is a problem in that the reinforcement mechanism hinders free movement of the legs of the user, and there are also problems in that the folding mechanism becomes more complicated, so that the cost of the table becomes more expensive.

Also, in the case of leg construction where a pair of legs are reinforced and fastened parallel to each other and installed on each end on the underneath side of the tabletop such that they can be folded, the support structure that is installed between the middle of the legs and the underneath surface of the tabletop may come in contact with the legs of the user. If a support member is not used or if it is too small, there are problems in that the tabletop may tilt due to loads on the corner, or the table may be weak against vibration or shaking.

Therefore, there is a strong demand for a foldable outdoor table that has a stable tabletop and that does not have any kind of structure along at least two parallel edges of the four edges of the tabletop from the corners to the center area on the underneath side of the tabletop.

Also, there are outdoor chairs having legs that can be folded underneath the seat for use together with the outdoor table, however, there has been no design of an outdoor table having two outdoor chairs that can be stored and carried together.

SUMMARY OF THE INVENTION

An object of this invention is to provide a portable outdoor table and chair set, in which the outdoor table and two outdoor chairs can be manufactured cheaply and can be folded and carried together, and where the tabletop is stable and does not have any kind of structure along two parallel edges of the tabletop from the corners to the center area on the underneath side of the tabletop, and furthermore where the tabletop and legs are not separated in order to prevent losing parts.

BRIEF DESCRIPTION OF THE INVENTION

FIG. 1 (A) and FIG. 1(B) are a bottom plan view of one example of the present invention where FIG. 1(A) shows one of a pair of outdoor chairs the legs of which are folded and an outdoor table which is folded and assembled with the one of the outdoor chairs folded, and where FIG. 1 (B) shows the other of the pair of outdoor chairs the legs of which are folded.

FIG. 13(A) is a perspective view to show an engagement member formed in an outdoor table of the present invention.

FIG. 13 (C) is a perspective view to show the engagement member of FIG. 13 (B) to which another bar is connected.

FIG. 13(D) is a perspective view of the connection portion of the another bar in FIG. 13(C).

DESCRIPTION OF THE PREFERRED EMBODIMENTS

Figure 1A:
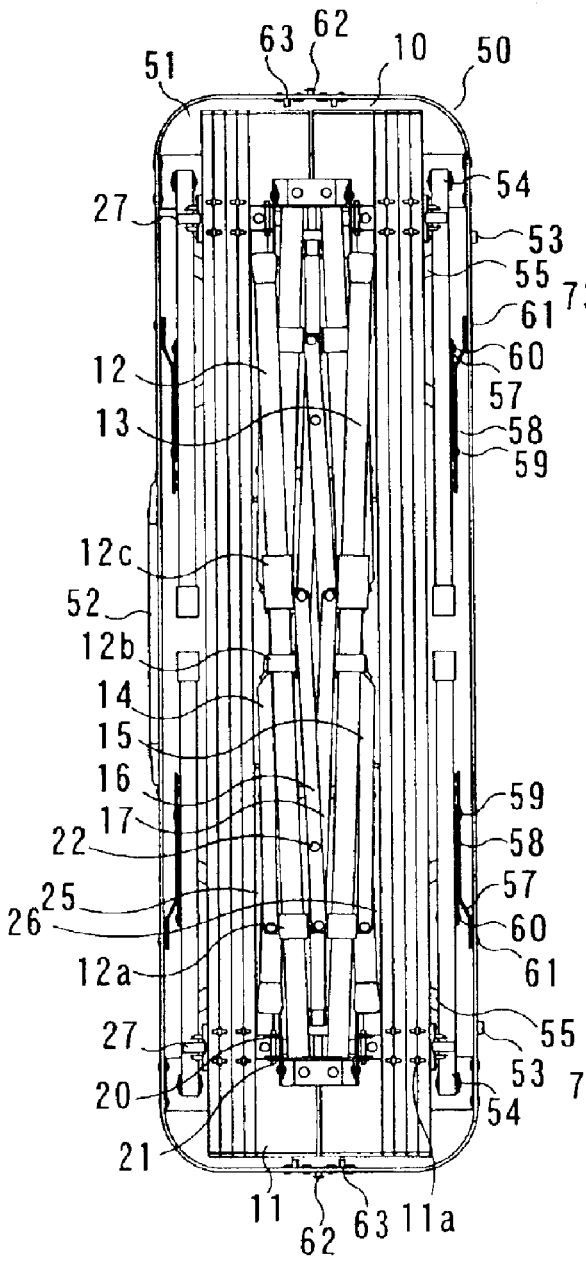

The outdoor table of this invention in an embodiment comprises a tabletop that has a plurality of slat members that are connected by a connection means such that they can be freely folded and unfolded, and a pair of table-leg assemblies with legs that are installed to one or two in the middle of the slat members such that they can be folded underneath the tabletop. The slat members of the tabletop to which the table-table-leg assemblies are attached has two pair of bars that run along the lower surface of the tabletop and can rotate from a state where they are parallel in the lengthwise direction of the slat member to where they are orthogonal to the opened up slat members of the tabletop, and a pair of the bars are connected to the lower surface of the tabletop at a location where one of the table-leg assemblies is attached, and can rotate in opposite directions around the location, and the other pair of bars are connected to the lower surface of the tabletop where the other table-leg assembly is attached, and can rotate in opposite directions around the location. There is a joint member on the underneath surface of the tabletop near both ends in the lengthwise direction of the two slat members on both ends of the tabletop orthogonal to the lengthwise direction, and the tip ends of the bars are constructed such that they can fit with the joint section. The number of slat members in the middle to which the table-table-leg assemblies are attached is essentially one where it can be wider than the other slat members, but can be two slat members that have been fastened together as illustrated.

The table-leg assemblies comprise a pair of legs, and first and second link members that are symmetrically attached to the two legs such that one end of the first link member is fastened to one of the legs and the other end of the first link member is slidably attached to the other leg while one end of the second link member is fastened to the other of the legs and the other end of the second link member is slidably attached to the one of the legs, so that it is possible to open and close the legs from a closed state, where the legs are almost parallel to each other, to an opened state, where the bottom ends of the legs are largely separated from each other and the top ends remain adjacent to each other.

There is a rotating member to mount the tip end of each of the legs of the table-leg assemblies to the underneath surface of the tabletop such that the legs can rotate by way of a leg-rotation shaft that extends perpendicular to the legs and in the opening/closing plane of the two legs. Each of these rotating members further has a leg-assembly rotation shaft that extends perpendicular to the leg-rotation shaft and to the opening/closing plane of the two legs, and these rotating members are attached to the underneath surface of the slat member(s) to which the table-leg assemblies are attached.

Also there is a support member rotatably installed to the legs at a location separated by a specified distance from the tip end of the legs, and the other end of the support member can rotatably fit with the outside end of the bars and is constructed such that it can be inserted into the aforementioned joint member in order to obtain a stable tabletop.

There is a support mechanism installed between the rotating shaft of the link mechanism of the table-leg assembly and the underneath surface of the slat member(s), to which the table-leg assembly is attached, at a middle portion of the slat members, and it comprises two link members connected by a shaft to each other with one link member connected to the rotating shaft and with the other to the underneath surface. These connections allow relative movements of the link members, and this support mechanism can be extended and closed between a stoppable extended state, which supports loads when the table-leg assembly is standing, and a bent or closed state when the table-leg assembly is folded, in order to obtain a stable tabletop. When the link members of the support mechanism move from the bent or closed state to the extended state, it is preferred that there be a locking member fastened to one of the link members that can fit with a mating structure on the other link member such that the link members can be extended and locked having a relative angle that exceeds 180 degrees when extending, such as 181 to 183 degrees on the lower side.

Or, a support mechanism is constructed with three link members. Two of the link members are attached to the two sliding ends of the link mechanism of the table-leg assembly, and one link member is attached to the underneath surface of the slat member(s) to which the table-table-leg assembly is attached, so that they are connected to each other in a Y-shape, such that they can rotate at the joint portion. The support mechanism can be extended to a stoppable extended state that supports a load when the table-leg assembly is standing, and can be closed to a closed or bent state when the table-leg assembly is folded, in order to obtain a stable tabletop.

The outdoor table and chair set of this invention comprises two outdoor chairs and an outdoor table, where each of the outdoor chairs comprises a seat, whose outer edge depending downward when in use, and a pair of chair-leg assemblies having a pair of legs that can fold up underneath the seat. The outdoor table as mentioned above comprises a tabletop comprising a plurality of slat members that are connected by a cord-type connection means such that they can be folded, and a pair of table-leg assemblies that are attached to one or two slat members and that can be folded up underneath the tabletop. The outdoor chairs have a means for fastening both of the folded chairs together such that the seat surfaces of the seats facing outward and the ends of the outer edges coming in contact with each other, and the folded outdoor table can be stored inside the empty space between the two fastened folded outdoor chairs.

The preferred embodiments of the inventions will be explained with reference to the drawings.

Figure 1B:
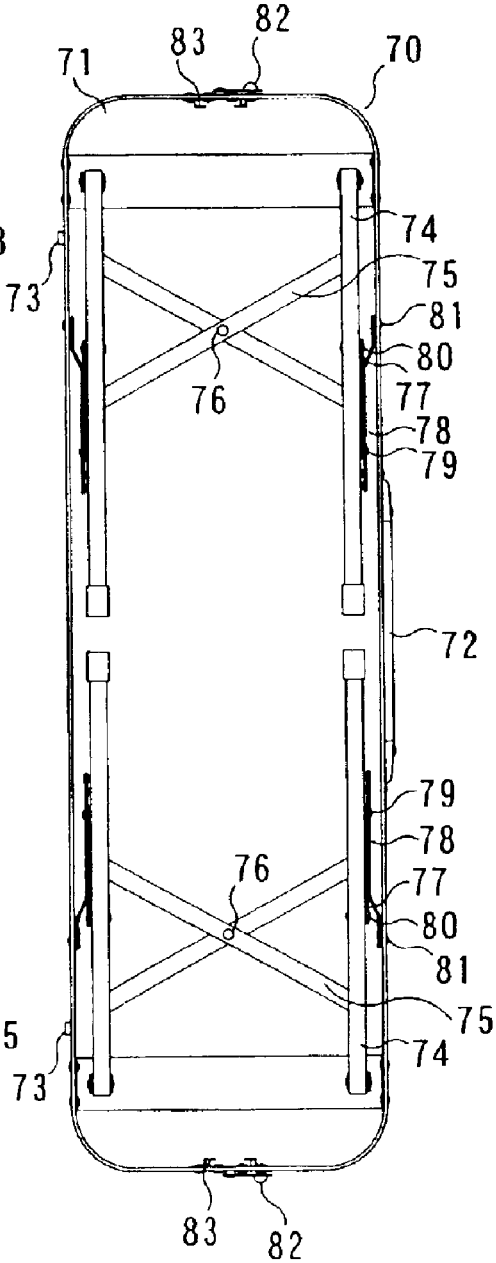
Figure 2:
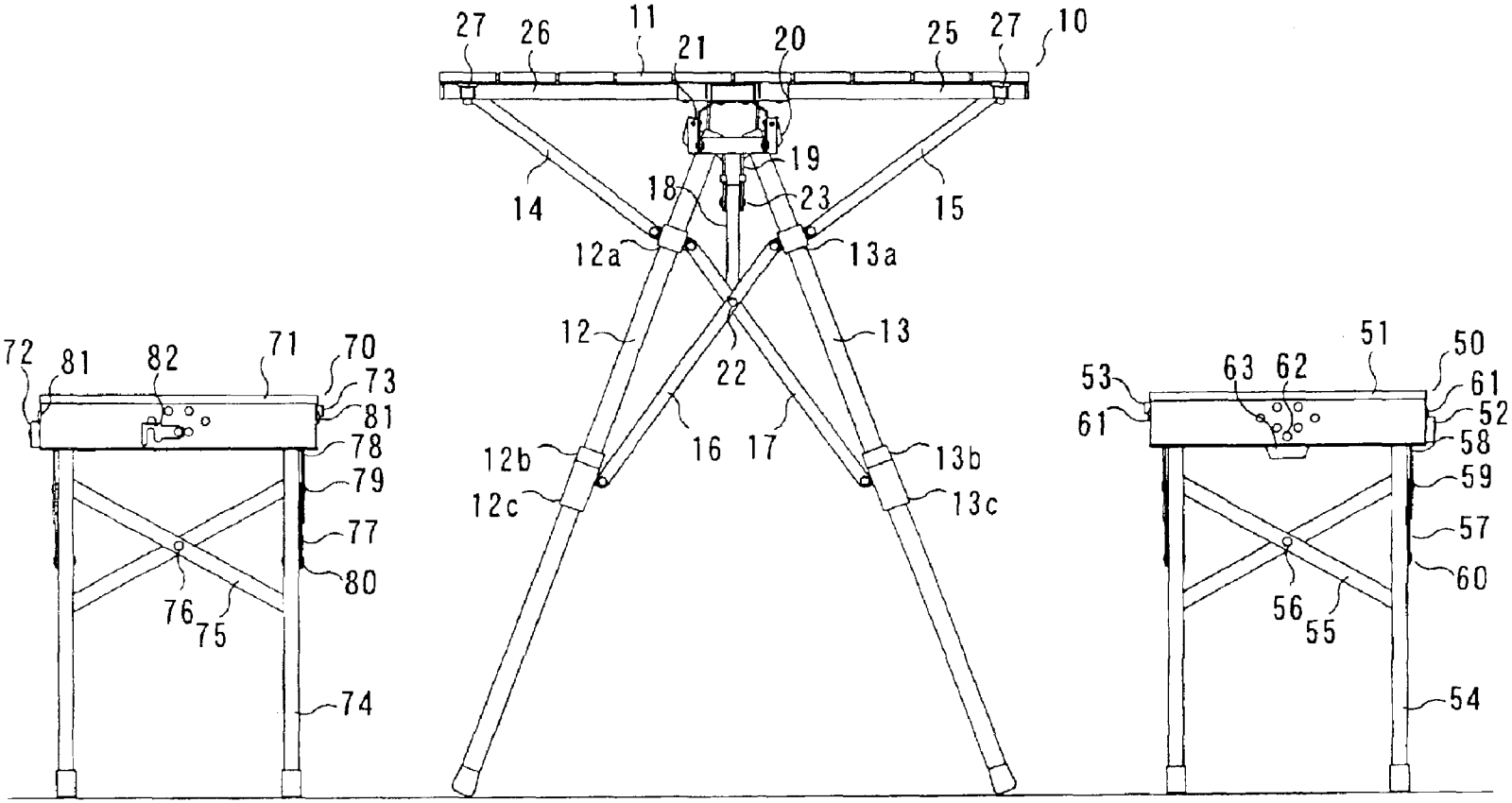
FIG. 2 is a front elevational view to show an example of the outdoor table and chair set according to the present invention in use.
Figure 3:
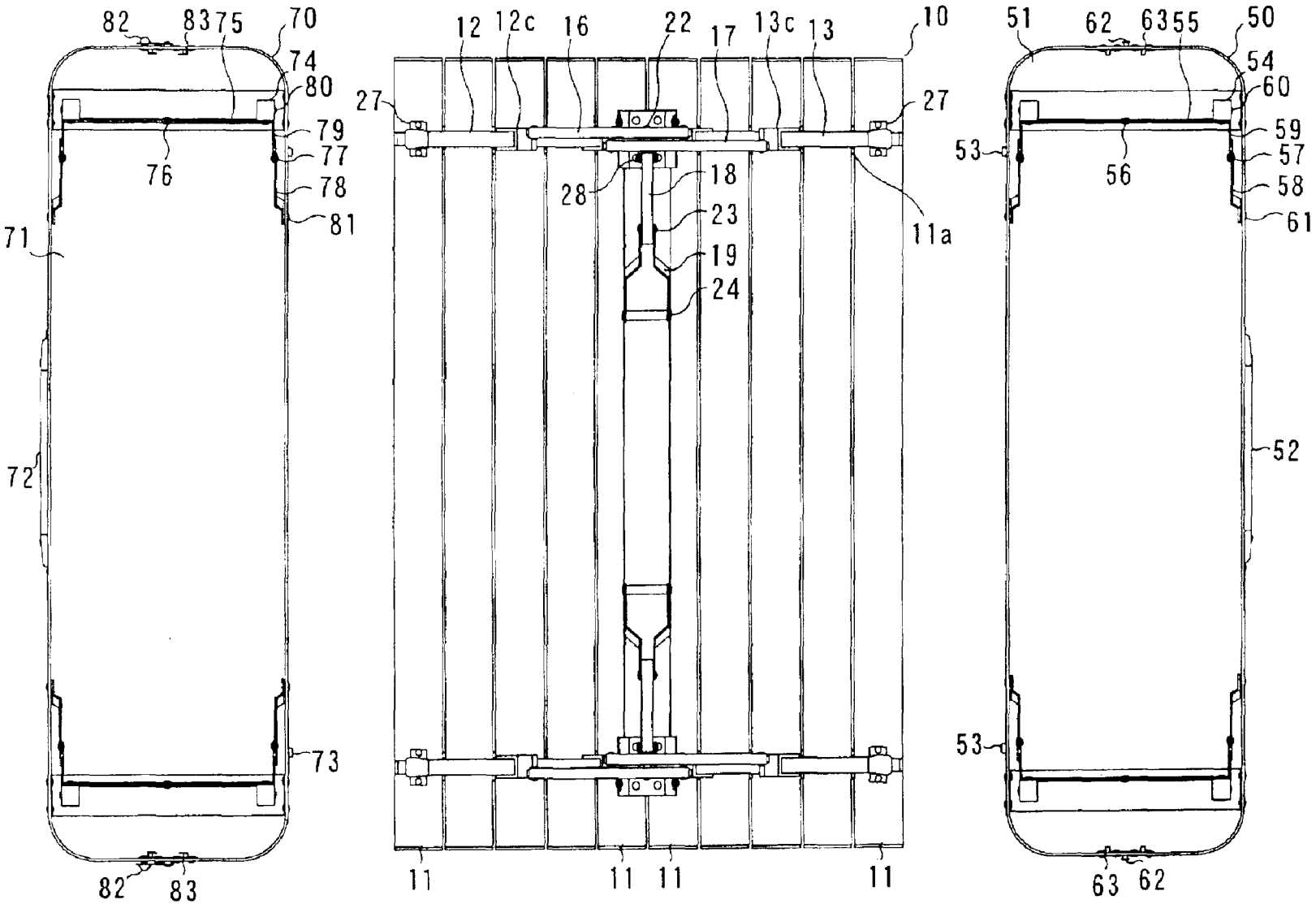
FIG. 3 is a bottom plan view to show the example in FIG. 2 of the present invention in use.
Figure 4:
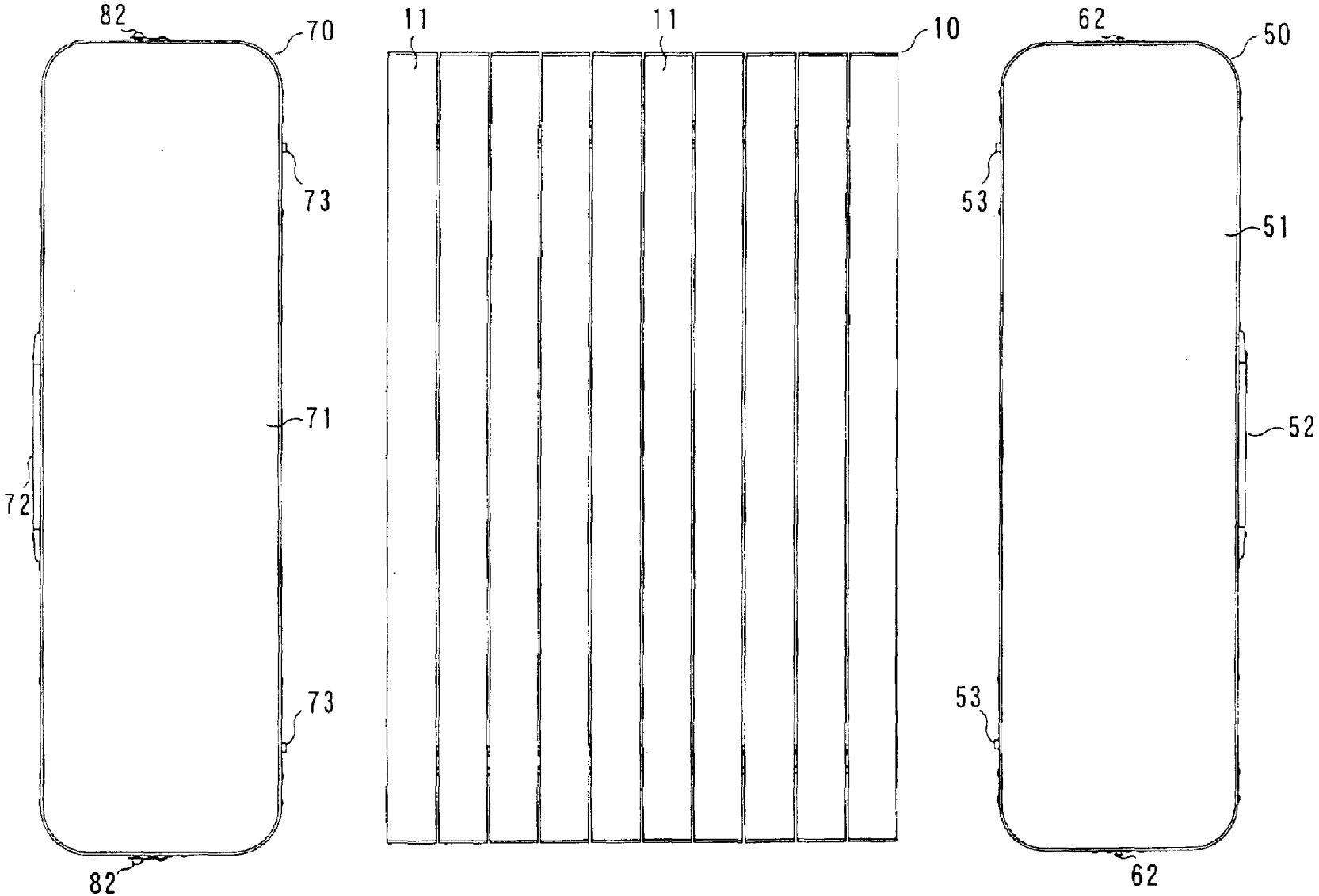
FIG. 4 is a top plan view to show the example in FIG. 2 of the present invention in use.
Figure 5:
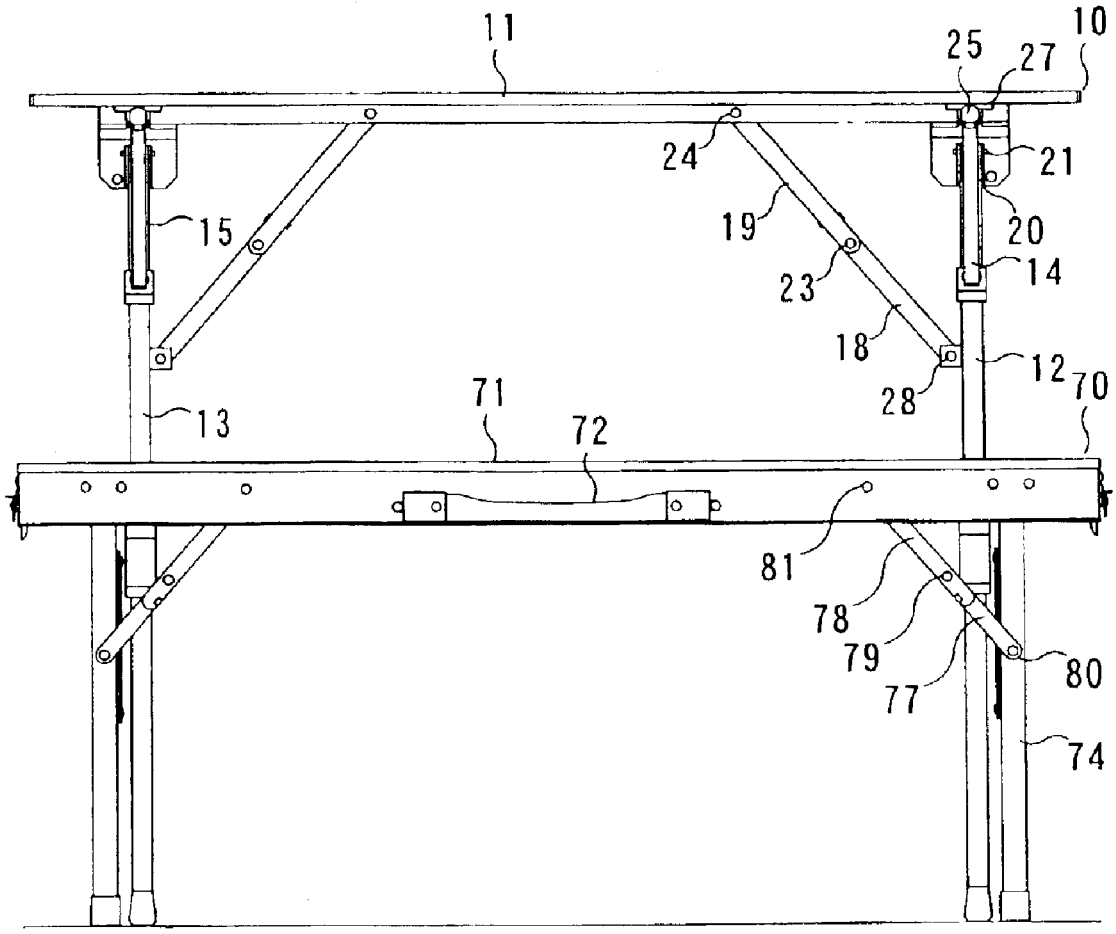
FIG. 5 is a side elevational view to show the example in FIG. 2 of the present invention in use.

FIG. 1(A) and FIG. 1(B) are a bottom plan view showing a pair of outdoor chairs 50, 70 the legs of which are folded, and a folded outdoor table 10 stored in the folded outdoor chair 50 with the legs of the table 10 folded. FIG. 2 is a front view showing the table 10 and chairs 50, 70 of FIG. 1 when in use. FIG. 3 is a bottom view of the table 10 and chairs 50, 70 of FIG. 2 when in use. FIG. 4 is a top view of the table 10 and chairs 50, 70 of FIG. 2 when in use. FIG. 5 is a side view of the table 10 and chairs of FIG. 2 when in use.

The outdoor table and chair set of this invention comprises two outdoor chairs 50, 70 and an outdoor table 10 as mentioned above.

The outdoor chairs 50, 70 comprise a seat with seat surfaces 51, 71 with their outer edges depending when in use and chair-leg assemblies that can fold up underneath the seat surfaces 51, 71.

The outdoor table 10 comprises a tabletop that has a plurality of slat members 11, which are connected by a well known cord-type connection means (not shown in the figures) for use as the tabletop, and they can be folded up for storing, and a pair of table-leg assemblies, which are attached to a pair of slats in the middle in the slat members 11 such that they can fold up underneath the tabletop for storing. In stead of the two slats, one broad slat can be used.

As shown in FIG. 10, the outdoor chairs 50, 70 can be put together such that the seat surfaces 51, 71 face outward. Also, as shown in FIG. 10, when the ends of outer edges of the chairs are brought into contact such that they face each other, there is a means that allows for the two folded outdoor chairs 50, 70 to be fastened together. As one example of the means for fastening the two outdoor chairs 50, 70 together, on the outer edge of the short sides of the outdoor chairs 50, 70 there are positioning fittings 63, 83 that are located on the inside, a fitting 62 with a large tip end, and a fastener 82 that hooks around and fastens to the fitting 62. The shapes of the fittings 62, 82, 63, 83 can be any known fitting and only one example is shown in FIGS. 8 to 10.

The folded outdoor table 10 can be stored inside the space between the two folded outdoor chairs 50, 70 that are fastened together.

Figure 11:
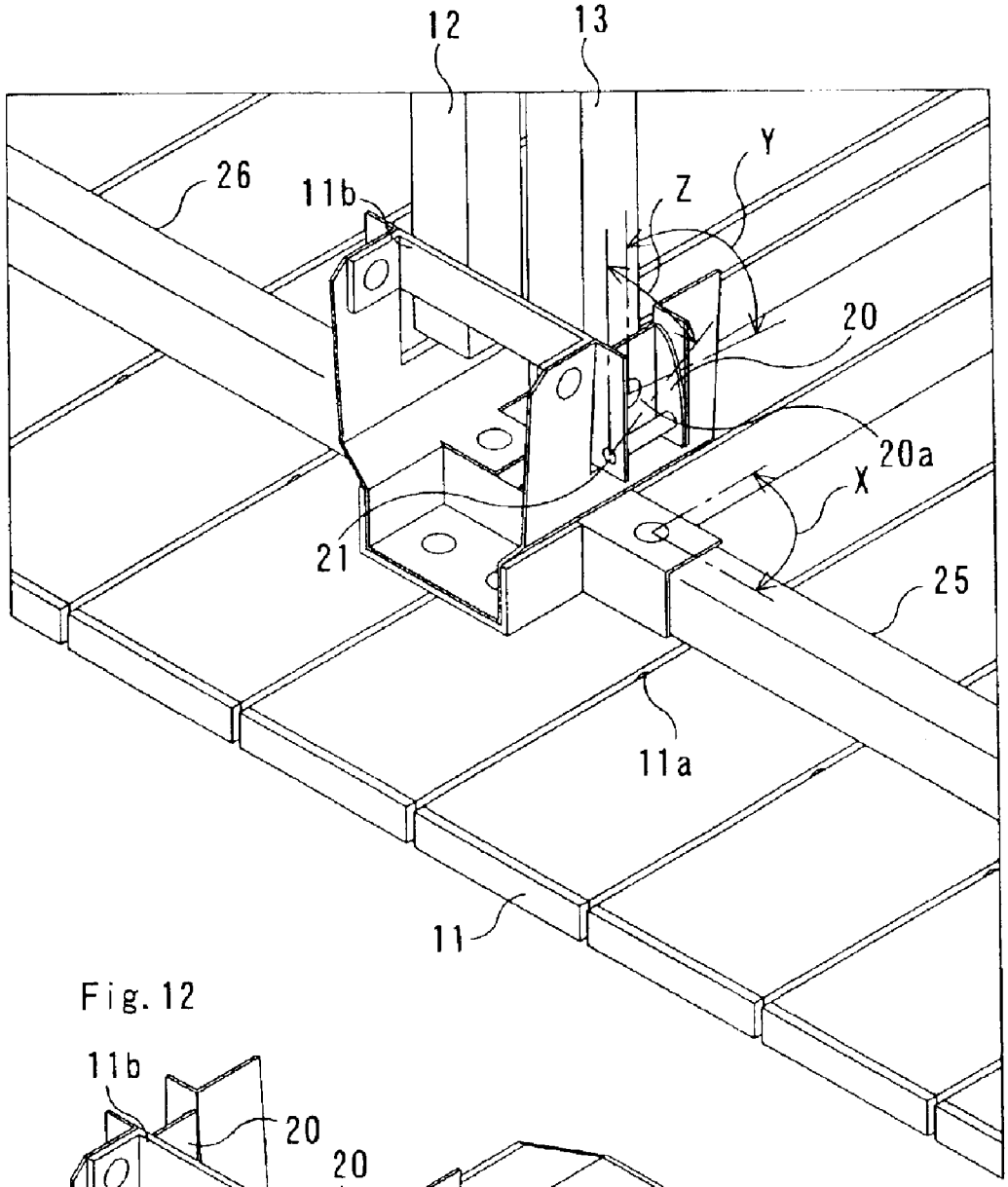
FIG. 11 is a perspective view to show a hinge structure of the leg members of an outdoor table of the present invention.
Figure 12:
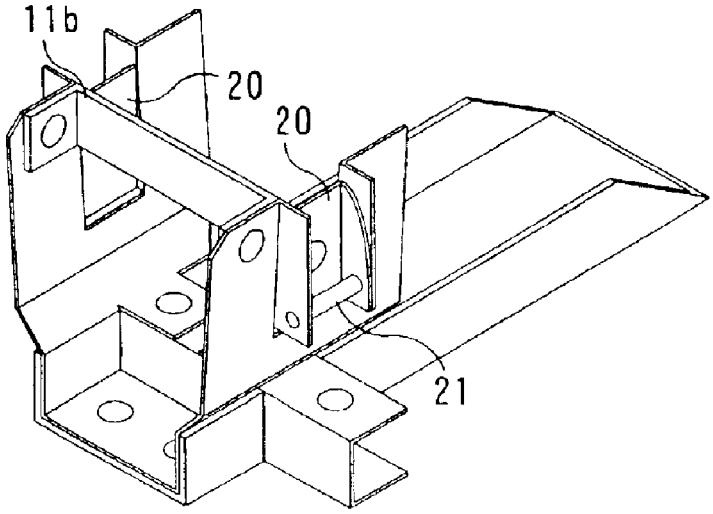
FIG. 12 is a perspective view of a member of the hinge structure.

As shown in FIG. 11, connected to the slat members 11 of the tabletop to which the table-table-leg assemblies are attached are two pairs of bars 25, 26 (one pair on one end of the slat bars 11 and the other pair on the other end), which can rotate within a range of rotation X from a state where they are almost parallel with the length direction of the slat members 11, to a state where they are orthogonal to and come in contact with the slat members 11 that are deployed or opened up into a flat surface that forms the tabletop (only one set including one pair of the bars 25, 26 is shown in the figures). Two bars 25, 26 can rotate in the direction opposite to each other at the location where one table-table-leg assembly is attached, and the other two bars 25, 26 can rotate in the direction opposite to each other at the location where the other table-table-leg assembly is attached.

There is a joint member 27 near the either lengthwise end on the underneath side of two slat members 11 located on both ends in the opening or deploying direction of the tabletop, and the tip end of each of the bars 25, 26 is provided with an engagement structure so as to fit with the joint member 27.

Figure 13:
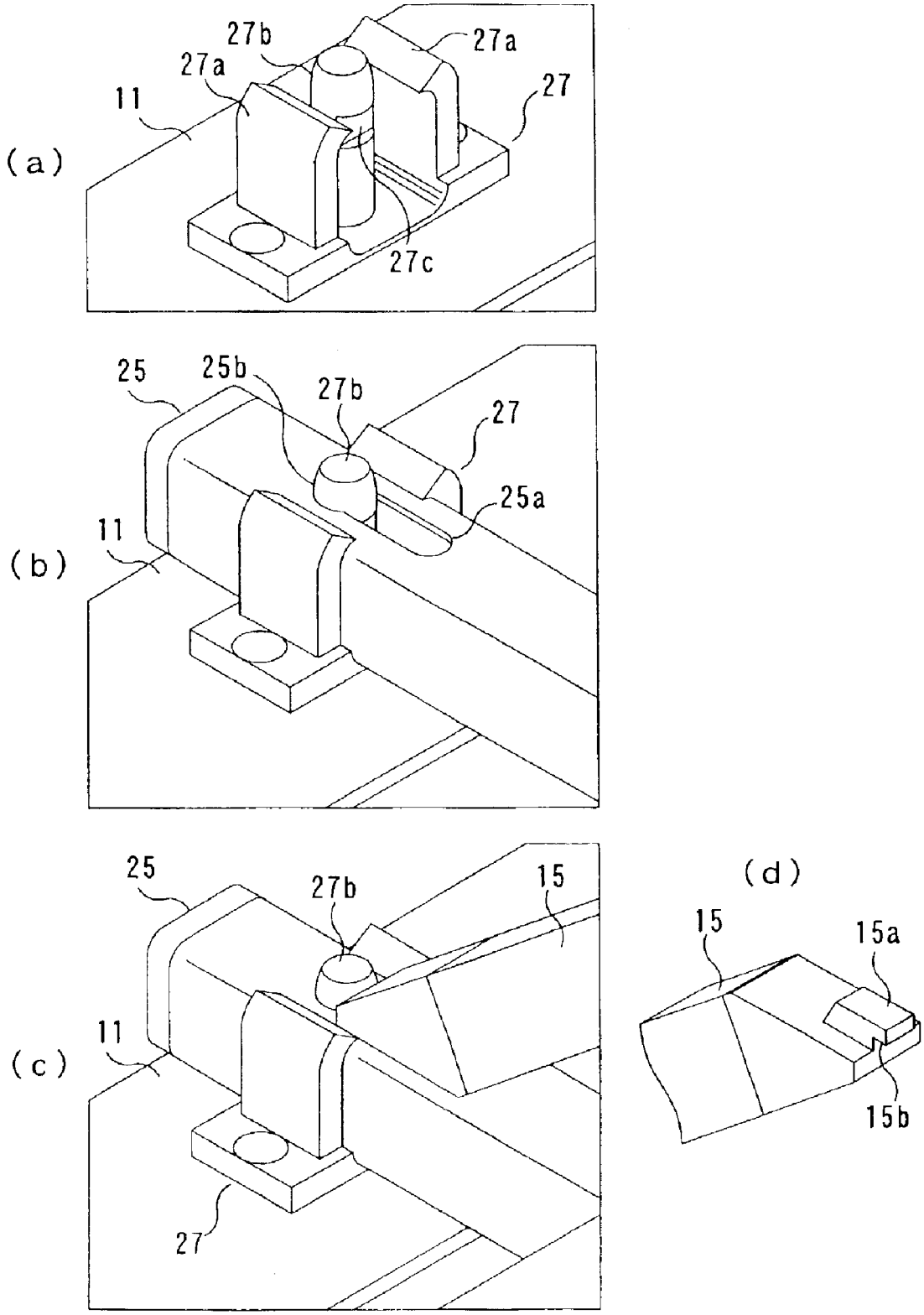
FIG. 13 (B) is a perspective view to show the engagement member of FIG. 13 (A) which receives a bar for fixing the outdoor table of the present invention.

A pictorial view of an example of the joint member 27 is shown in FIG. 13(A). As shown in FIG. 13(B), a hole 25*b* is formed in the bar 25 to form an engagement structure which can fit with the joint member 27. The joint member 27 comprises a protrusion 27*b* that can pass through the hole 25*b* and a pair of elastic pieces 27*a* that can fasten around the bar 25 as shown in FIG. 13(B). Also, the protrusion 27*b* is formed with a circumferential groove 27*c*. The bar 25 is pressed into and held between the pair of elastic pieces 27*a*. Also, the bar 25 has a hole 25*a* formed connecting to the hole 25*b* while a protrusion 15*a* is formed on the tip end of a support member 15 as shown in FIG. 13(D), and the protrusion 15*a* can fit into the hole 25*a* (see FIG. 13(C)).

The construction of the joint member 27, and the construction for fitting the bar 25 together with the support member 15 are not limited to the examples shown in the figures, and any construction can be used as long as the same functional effect is obtained.

As shown in FIG. 2, the table-leg assemblies comprises two legs 12, 13 and a link mechanism comprising link members 16, 17 that are symmetrically attached to the middle of the legs 12, 13. One end of the link member 17 is fastened to one leg 12 by a connecting member 12*a*, and the other end is fastened to the other leg 13 by a sliding member 13*c* such that it can slide. Similarly, one end of link member 16 is fastened to the other leg 13 by a connecting member 13*a*, and the other end is fastened to the one leg 12 by a sliding member 12*c* such that it can slide. With this link mechanism, the legs 12, 13 can be opened and closed between the closed position, where they are brought together in a substantially parallel position as shown in FIG. 1, and the opened position, where the bottom ends of the legs 12, 13 are largely separated from each other while keeping the top ends adjacent to each other, as shown in FIG. 2. Sliding of the sliding members 12*c*, 13*c* is limited by the fixing members 12*b*, 13*b* that are fastened to the legs 12, 13, such that the legs are secure and stable in the opened position.

The top ends of each of the legs 12, 13 of the table-table-leg assemblies have rotating members 20 as shown in FIG. 11. The rotating member 20 is installed such that it can rotate only within a range of rotation Y via a leg-rotation shaft 20*a* that is perpendicular to the leg 12 and located in the opening/closing plane of the two legs 12, 13. In addition, these rotating members 20 have a leg-mechanism rotation shaft 21 perpendicular to the leg-rotation shaft 20*a*, so that they can rotate only within a range of rotation Z. The leg-rotation shaft 20*a* and the leg-mechanism rotation shaft 21 are integrally combined in the rotating members 20. The rotating members 20 are attached to the tabletop underneath the slat members 11 to which the table-leg assembly is attached.

As shown in FIG. 2, there are rotating support members 14, 15 installed at locations that are separated a specified distance from the tip ends of each leg 12, 13, and the upper ends of these support members 14, 15 rotatably fit with the outside ends of the bars 25, 26 and are also constructed such that they can fit into the joint member 27 and thus make it possible to obtain a stable tabletop.

As shown in FIG. 3 and FIG. 5, between the rotating axis 22 of the link mechanism of the table-leg assembly and the underneath surface of the pair of slat members 11 in the middle to which the table-leg assembly is attached, there is an extendable support structure that can extend to a stoppable extended state, which supports loads when the table-leg assembly is standing, and closed to a closed or bent state when the table-leg assembly is folded up, making it possible to obtain a stable tabletop. As an example of the support structure, the figures show a rotating shaft 28 that is attached to the rotating shaft 22 of the table-leg assembly, a first link member 18, second link member 19, a rotating shaft 23 that links the first link member 18 and second link member 19 such that they can rotate, and a rotating shaft 24 that connects the second link member 19 and the slat members 11 such that the second link members 19 can rotate.

Figure 6:
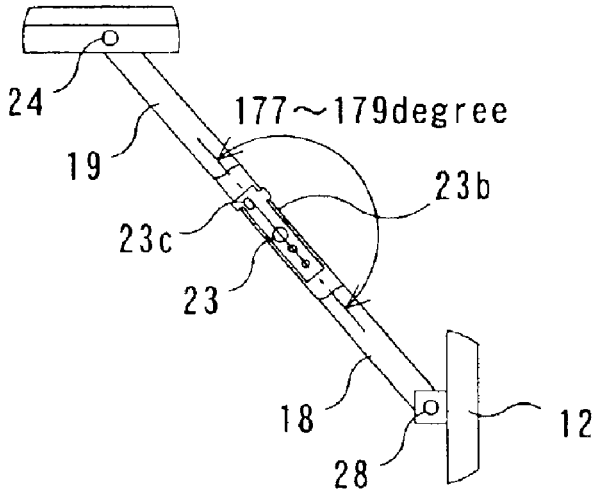
FIG. 6 is a partially cut away, side elevational view to show an example of a lock member used in the present invention.
Figure 7D:
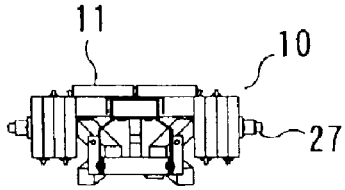
FIG. 7(D) is a rear elevational view to show the outdoor table of FIG. 7(A).
Figure 7A:
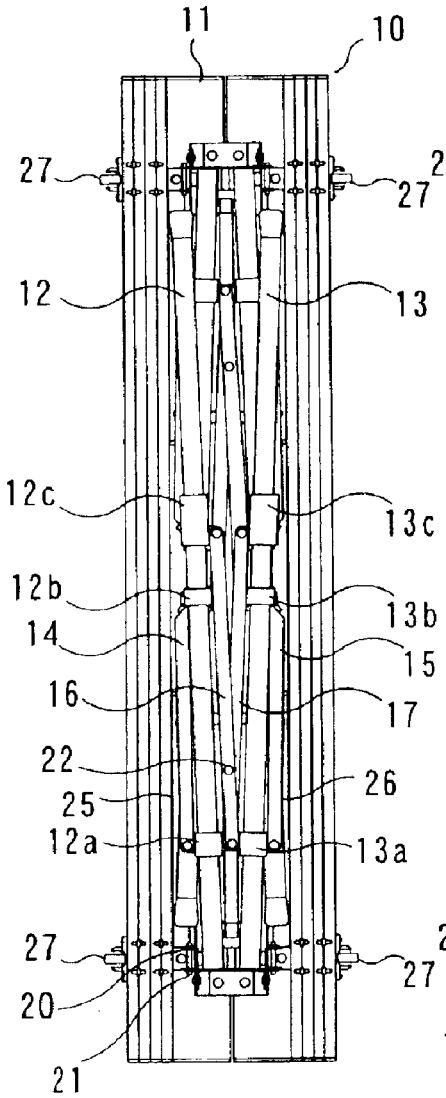
FIG. 7(A) is a bottom plan view to show an outdoor table which is folded.
Figure 7B:
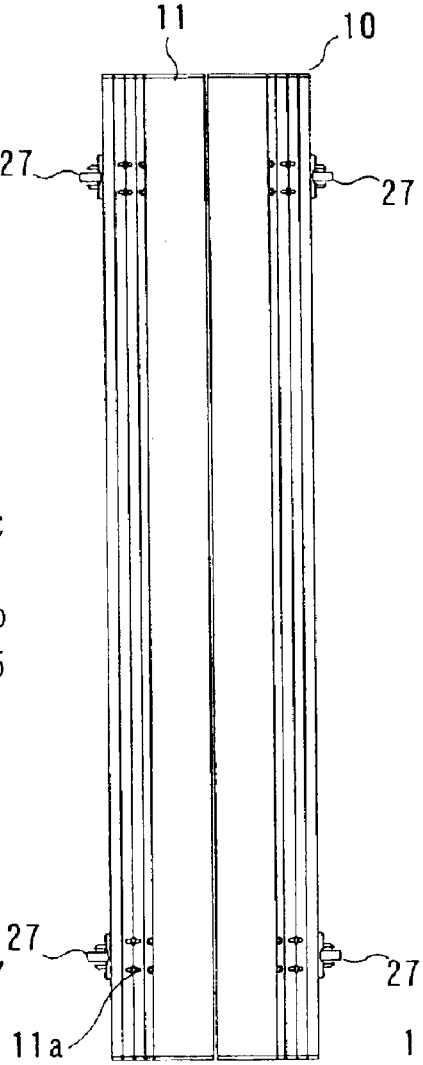
FIG. 7(B) is a top plan view to show the outdoor table of FIG. 7(A).
Figure 7C:
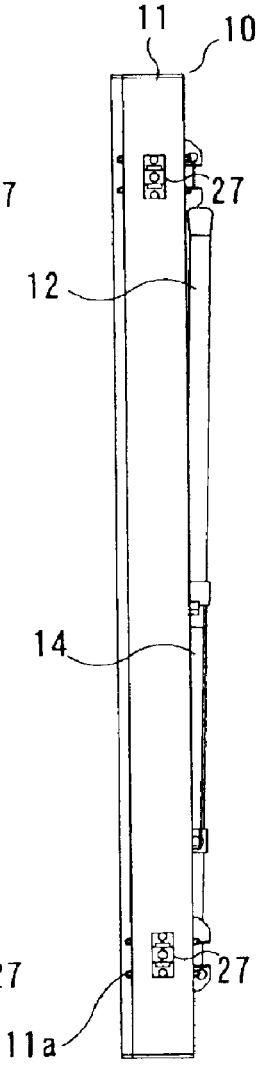
FIG. 7(C) is a side elevational view to show the outdoor table of FIG. 7(A).
Figure 8E:
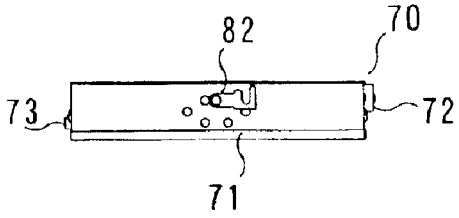
FIG. 8(E) is a rear elevational view to show the outdoor chair of FIG. 8(A).
Figure 8C:
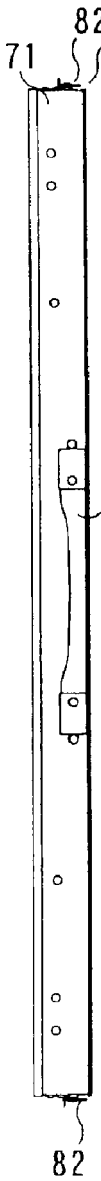
FIG. 8(C) is a side elevational view to show the outdoor chair of FIG. 8(A).
Figure 8A:
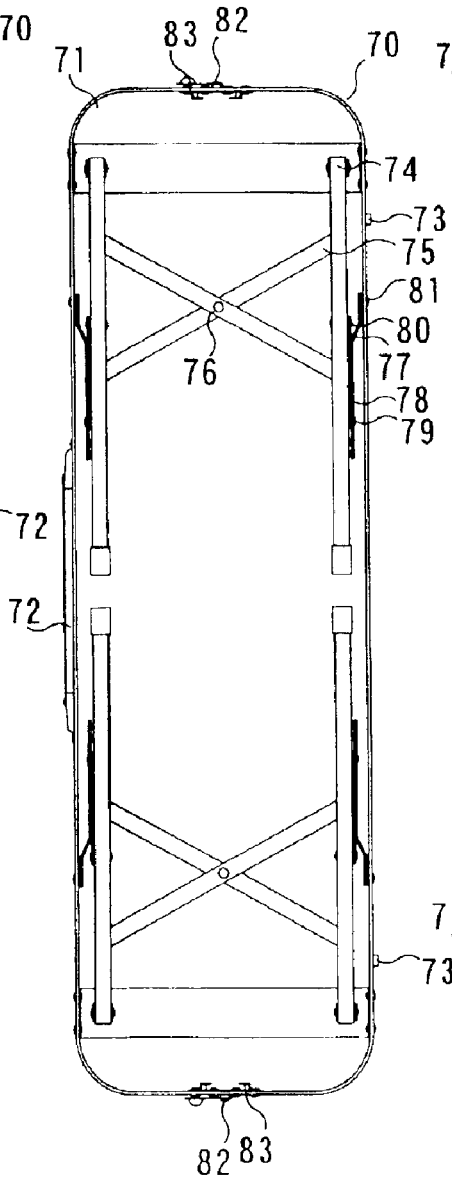
FIG. 8(A) is a bottom plan view to show one of the pair of outdoor chairs the legs of which are folded.
Figure 8D:
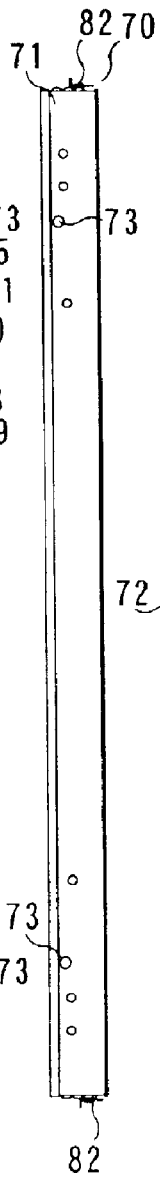
FIG. 8(D) is another side elevational view to show the outdoor chair of FIG. 8(A).
Figure 8B:
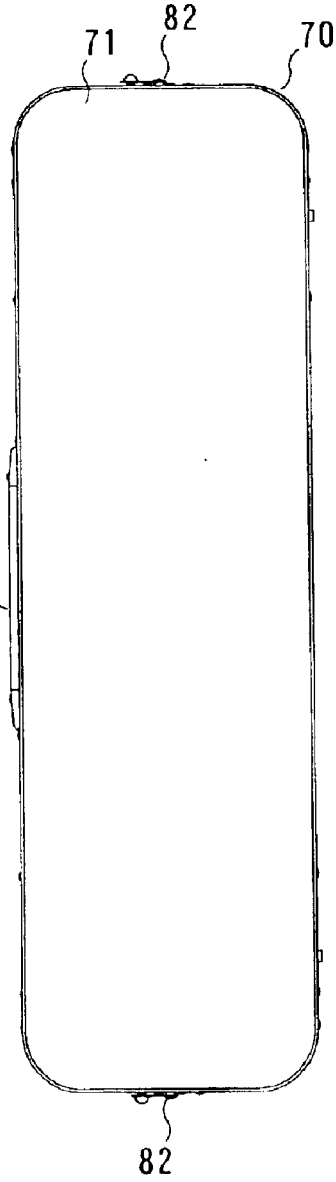
FIG. 8(B) is a top plan view to show the outdoor chair of FIG. 8(A).
Figure 9E:
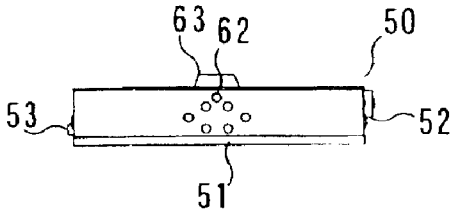
FIG. 9(E) is a rear elevational view to show the outdoor chair of FIG. 9(A).
Figure 9C:
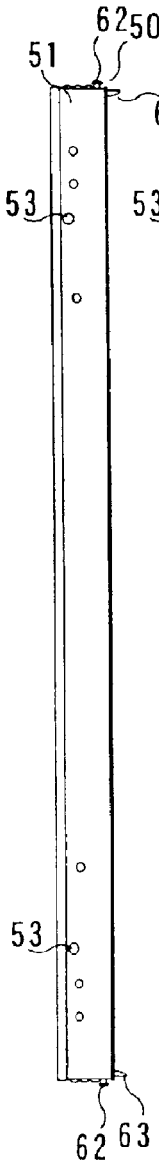
FIG. 9(C) is a side elevational view to show the outdoor chair of FIG. 9(A).
Figure 9A:
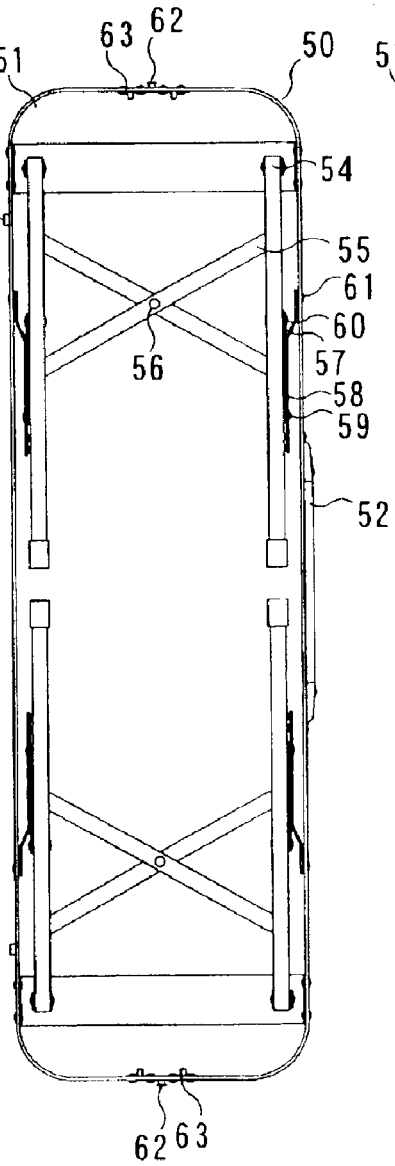
FIG. 9(A) is a bottom plan view to show the other of the pair of outdoor chairs the legs of which are folded.
Figure 9D:
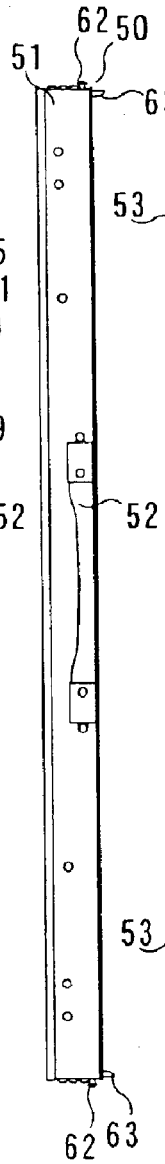
FIG. 9(D) is another side elevational view to show the outdoor chair of FIG. 9(A).
Figure 9B:
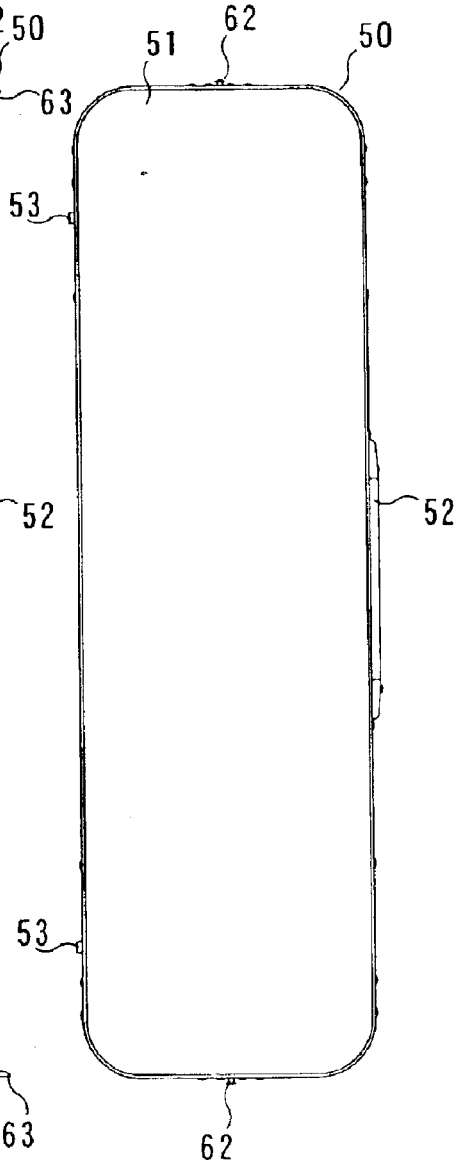
FIG. 9(B) is a top plan view to show the outdoor chair of FIG. 9(A).
Figure 10D:
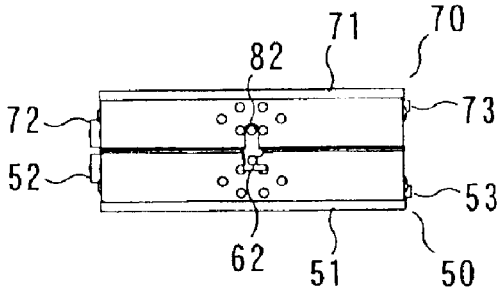
FIG. 10(D) is a rear elevational view to show the outdoor chair of FIG. 10(A).
Figure 10A:
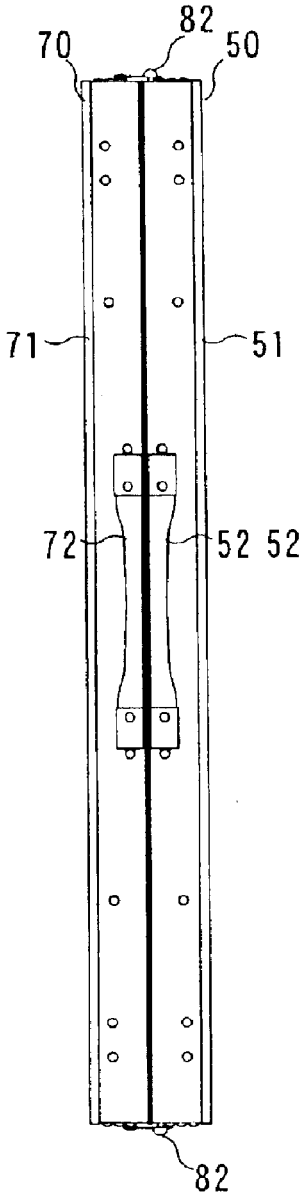
FIG. 10(A) is a side elevational view to show the pair of outdoor chairs in FIG. 8 and FIG. 9 which are assemble together.
Figure 10B:
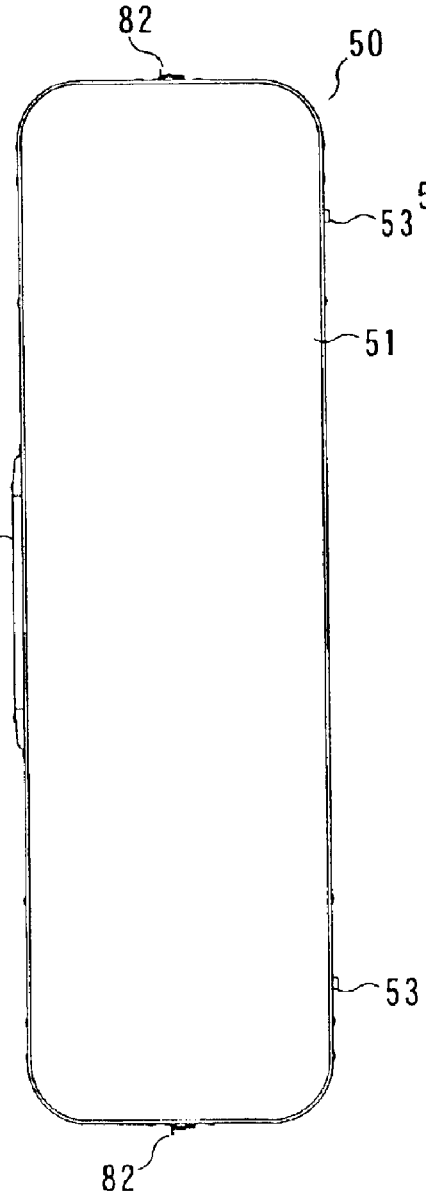
FIG. 10(B) is a top plan view to show the outdoor chair of FIG. 10(A).
Figure 10C:
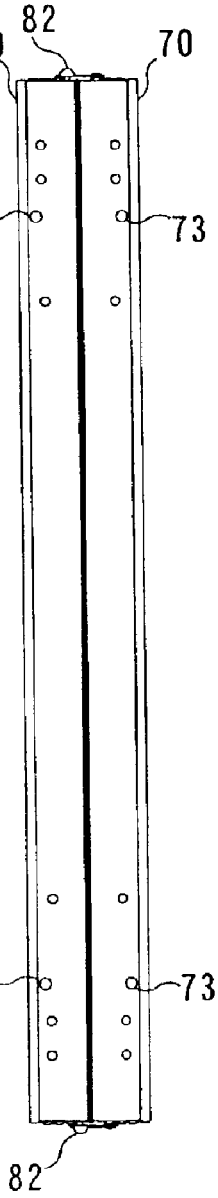
FIG. 10(C) is another side elevational view to show the outdoor chair of FIG. 10(A).

When the first link member 18 and the second link member 19 go from the bent state to the extended state shown in FIG. 5, there is a locking member 23*b* as shown in the partial view shown in FIG. 6 that is fastened to one of them, i.e., the first member 18 in the figure and can fit with an engagement structure formed on the other of them, i.e. the second member 19 in the figure such that the lower angle between the members 18, 19 (lower bottom angle in FIG. 5 and FIG. 6) exceeds 180 degrees and reaches an angle of 181 to 183 degrees, or in other words, such that the upper angle is 177 to 179 degrees as shown in FIG. 5 and FIG. 6. This engagement structure can be formed such that there is a protruding section 23*c* on the locking member 23*b* and a depressed section can be formed and positioned on the second link member 19 such that in the extended state they can be set with the positional relationship described above.

With this support mechanism, the table-leg assembly is controlled such that it can only rotate within a range of about 90 degrees, and as shown in FIG. 11, it is also possible to use a stopper 11*b*.

A lightweight, sturdy and easily processed material, such as a hollow aluminum alloy, can be used for all of the members, and a synthetic resin or plastic material that has low friction and that will not scratch the other members can be used for the ends and sliding parts.

The embodiment shown in the figures for explaining the invention is an example of the optimum design and the range of this invention is not limited by this embodiment.

The design for folding and storing the outdoor table of this embodiment so that it can be carried will be explained with reference to the drawings. The table can be set up using a procedure opposite from that explained below. FIG. 7 is a projection drawing showing the folded outdoor table. FIG. 8 is a projection drawing showing one of the folded outdoor chairs. FIG. 9 is a projection drawing showing the other folded outdoor chair. FIG. 10 is a projection drawing showing the combination of the folded outdoor chairs in a carrying state.

First, the tip ends of the support members 14, 15 are disconnected from the holes in the bars 25, 26 and then the support members 14, 15 are rotated to a position along the legs 12, 13. The bars 25, 26 are disconnected from the joint members 27 and rotated to the length direction of the slat members 11. By folding the cord-type connection means into an S-shape, the plurality of slat members 11 of the tabletop can be stacked as shown in FIG. 7. Also, after closing the legs 12, 13 such that they are parallel to each other, the support structures of link members 18, 19 are folded and rotated one at a time such that they run along the underneath surface of the tabletop. By performing the above, the two pairs of table-leg assemblies are placed one on top the other, and stored compactly between the halves of the folded slat members 11. Furthermore, the slat members 11 can be bound with a rubber cord so they do not open up into a flat surface.

Next, as was shown in FIG. 8 and FIG. 9, the chair-leg assemblies of the two outdoor chairs are folded, and as shown in FIG. 1, the folded outdoor table 10 is stored in the section underneath the seat 51 of one of the outdoor chairs 50, and as shown in FIG. 10, the other outdoor chair 70 is placed such that the seat surfaces 51, 71 of both chairs face outward and such that the ends of the edges face and come in contact with each other. Here it is possible to fasten the fitting 63 (see FIG. 9) and fitting 83 (see FIG. 8) and easily fasten the chairs together.

In the embodiment shown in the figures, the fitting 63 and fitting 83 are located on both ends in the lengthwise direction, however, it is possible to use well known type fittings (not shown in the figure) in locations in the width direction that are symmetrical with respect to the handle 52 or handle 72 that can fit and fasten together, or it is even possible to use both.

Finally, by hooking the fitting 82 over the fitting 62 on both ends, the chairs are securely fastened together. Furthermore, by using handles 52, 72 and feet 53, 73 on the side surfaces of the outdoor chairs 50, 70, it becomes easy to carry and handle the table and chairs.

Figure 14:
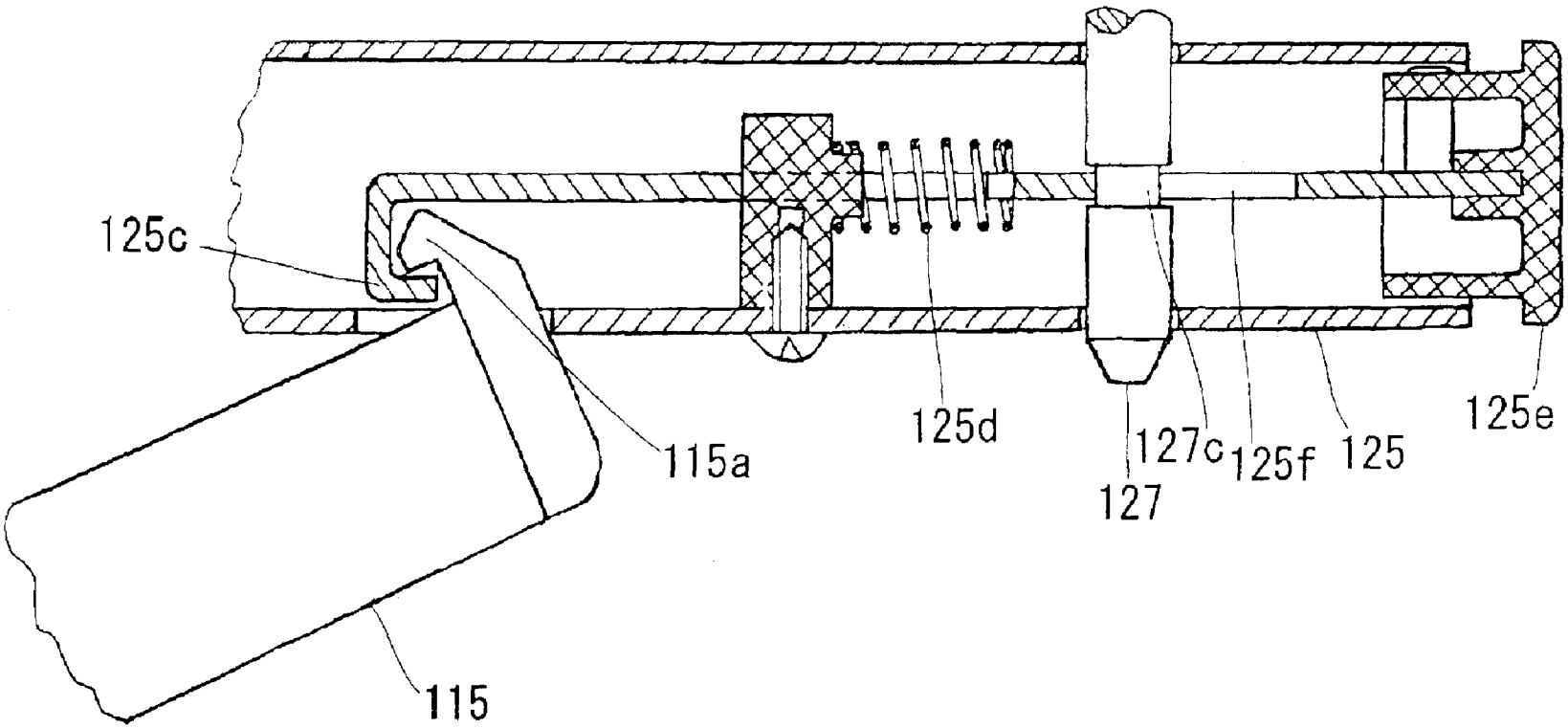
FIG. 14 is a partly cut-away cross sectional view to show another example of the engagement member of the present invention.

Next, another different example is explained referring to FIG. 14 in a cross sectional view.

The bar 125 has a rotating axis at its base end and a hook structure 125*c* at its tip end. The hook structure 125*c* is released manually and restored automatically in a mechanism. A support member 115 is mounted to the legs (not shown) at a position spaced from the upper end by a predetermined distance. The support member 115 has a rotating axis at its base end connected to a leg and an engagement structure 115*a* at its tip end. The engagement structure 115*a* can be engaged with the hook structure 125*c* as the support member 115 is rotated around the rotating axis. The hook structure 125*c* which is engaged with the support member 115 is engaged with the connection structure 127 of the tabletop.

The hook structure 125*c* of the bar 125 can be manually released using the button 125*e*, and automatically restored by the spring member 125*d*. The joint member of the tabletop is provided with a groove 127*c* which is engaged with the hole 125*f* in the hook structure 125*c*.

Accordingly, with the properly controlled dimension relation, the engagement structure 127 of the tabletop and the support member 115 are simultaneously released through operation of the button 125*e*. Similar structure is applied to the support member 114.

Figure 15:
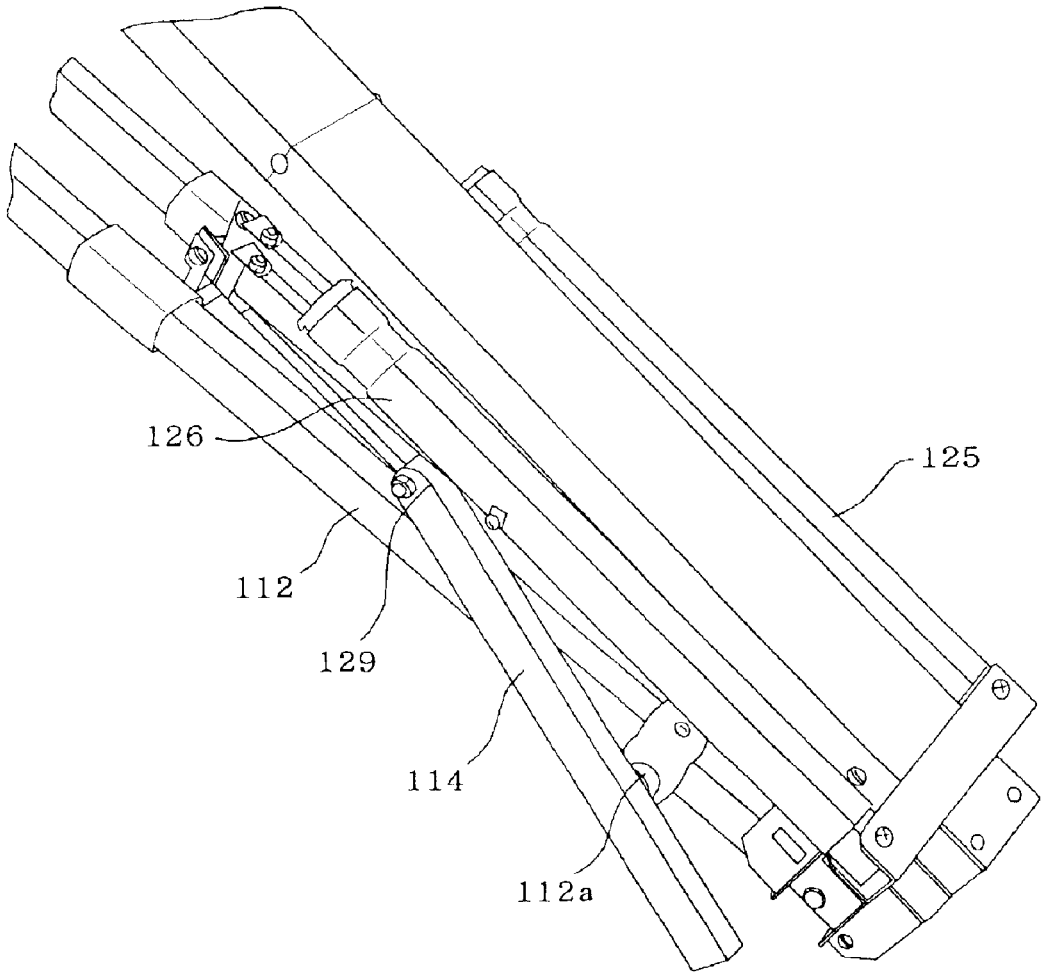
FIG. 15 is a partly cut away, perspective view of a table-leg assembly of the present invention in a fold state.
Figure 16:
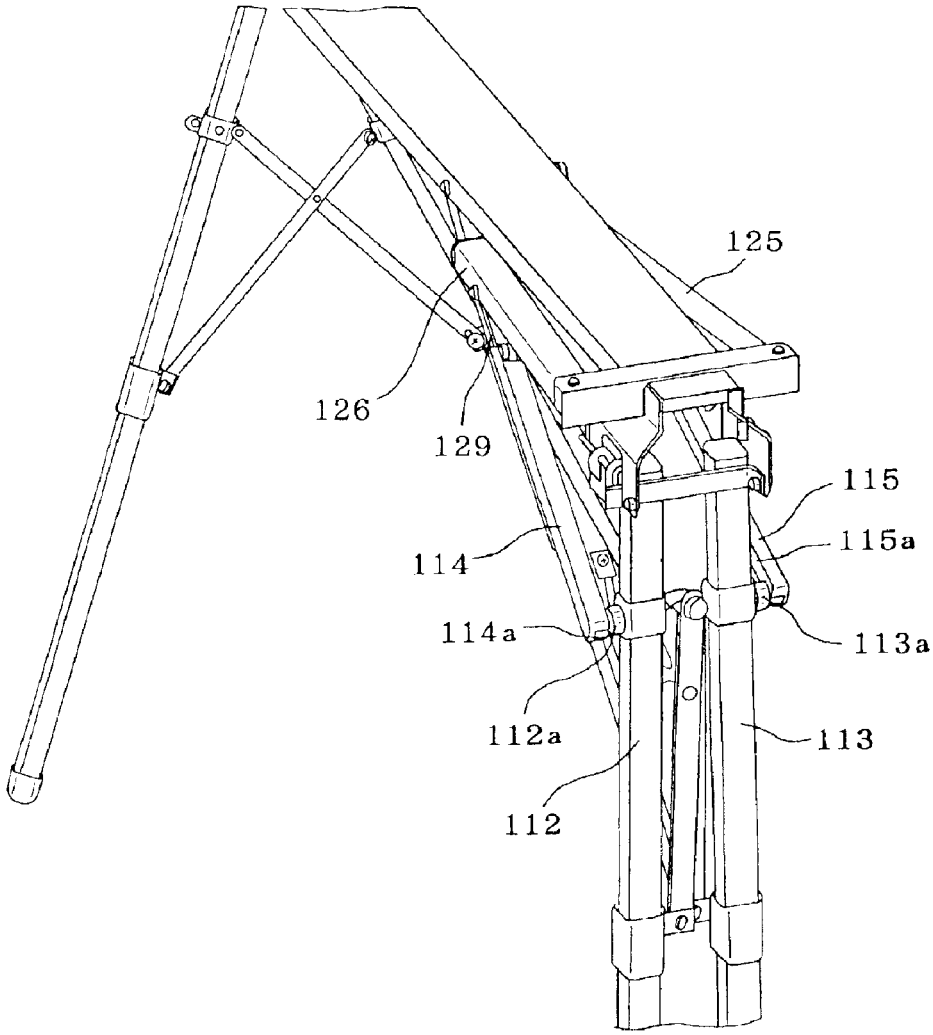
FIG. 16 is a perspective view to show a pair of legs in the table-leg assembly of FIG. 15 just before being opened for standing.
Figure 17:
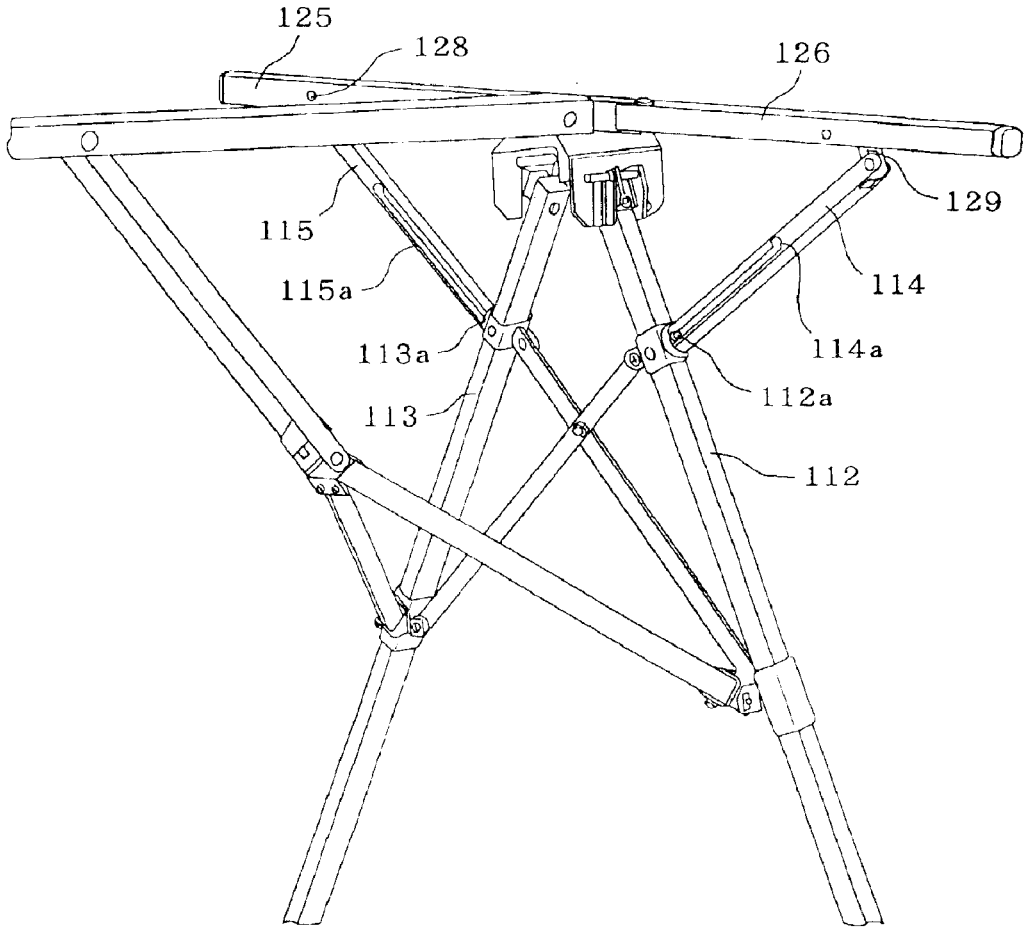
FIG. 17 is a a perspective view to show a pair of legs in the table-leg assembly of FIG. 15 in an opened state for use

Next, further different example is explained referring to FIGS. 15 to 17 in a perspective view.

FIG. 15 is a partly cut away, perspective view of a table-leg assembly of the present invention in a folded state. FIG. 16 is a perspective view to show a pair of leg assemblies with one of them in an opened state for standing.

FIG. 17 is a partly cut-away perspective view to show a pair of legs in a leg assembly in an opened state for use. In FIGS. 16 and 17, the tabletop is removed for simplifying the description.

Joint structures 112*a*, 113*a* are mounted to the legs 112, 113 respectively at a position spaced from the upper end, and the joint structures 112 *a*, 113*a* has a projection in a spherical necked shape. Support members 114, 115 are provided to have a groove 114*a*, 115*a* on two continuing surfaces, e.g. end face and side surface, in which the projection of the joint structures 112*a*, 113*a* can be slided.

Support jigs 128, 129 are mounted to the bars 125, 126 at a portion near the outside end, and to the tip end of the support members 114, 115 by way of a rotating shaft such that they can rotate with reference to the outside end of the bars 125, 126.

In the state where the leg structure is closed as in FIG. 15, the joint structure 112*a* is located at one end of the groove 114*a* at the middle area of the support member 114. In the state where the leg structure is stood up as in FIG. 16, the joint structure 112*a* is slided through the groove 114*a* and located closer to the other end of the support member 114. In the state where bars 125, 126 are extended as shown in FIG. 17, the joint structures 112*a* are moved toward the lower end surface of the support member 114, 115 in which the groove 114*a* is continued to the lower end face. Thus, the tabletop is stably supported.

Figure 18:
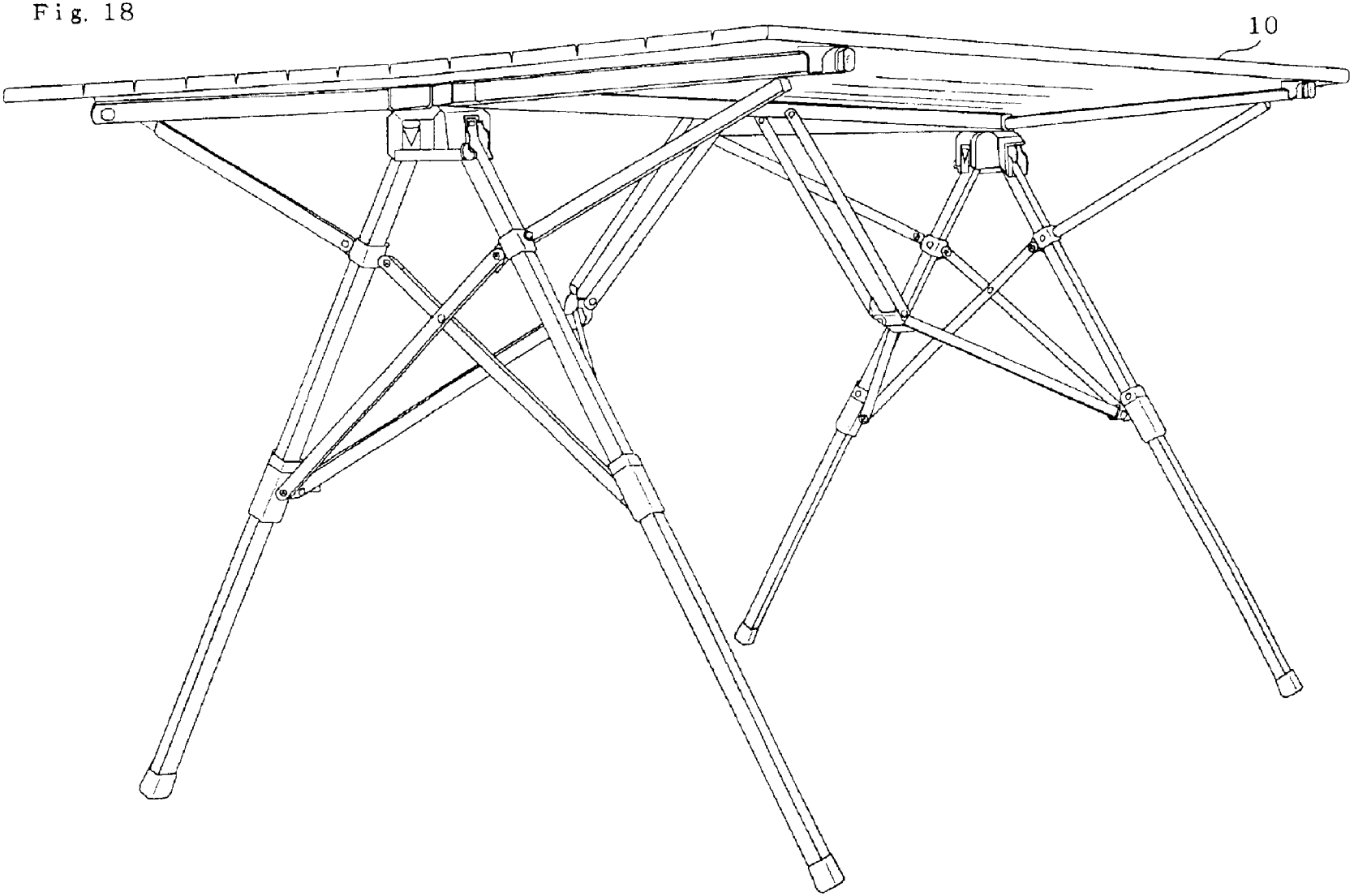
FIG. 18 is a perspective view of an outdoor table according to another example of the present invention.

FIG. 18 shows a whole structure of the outdoor table according to an example of the present invention.

Figure 19:
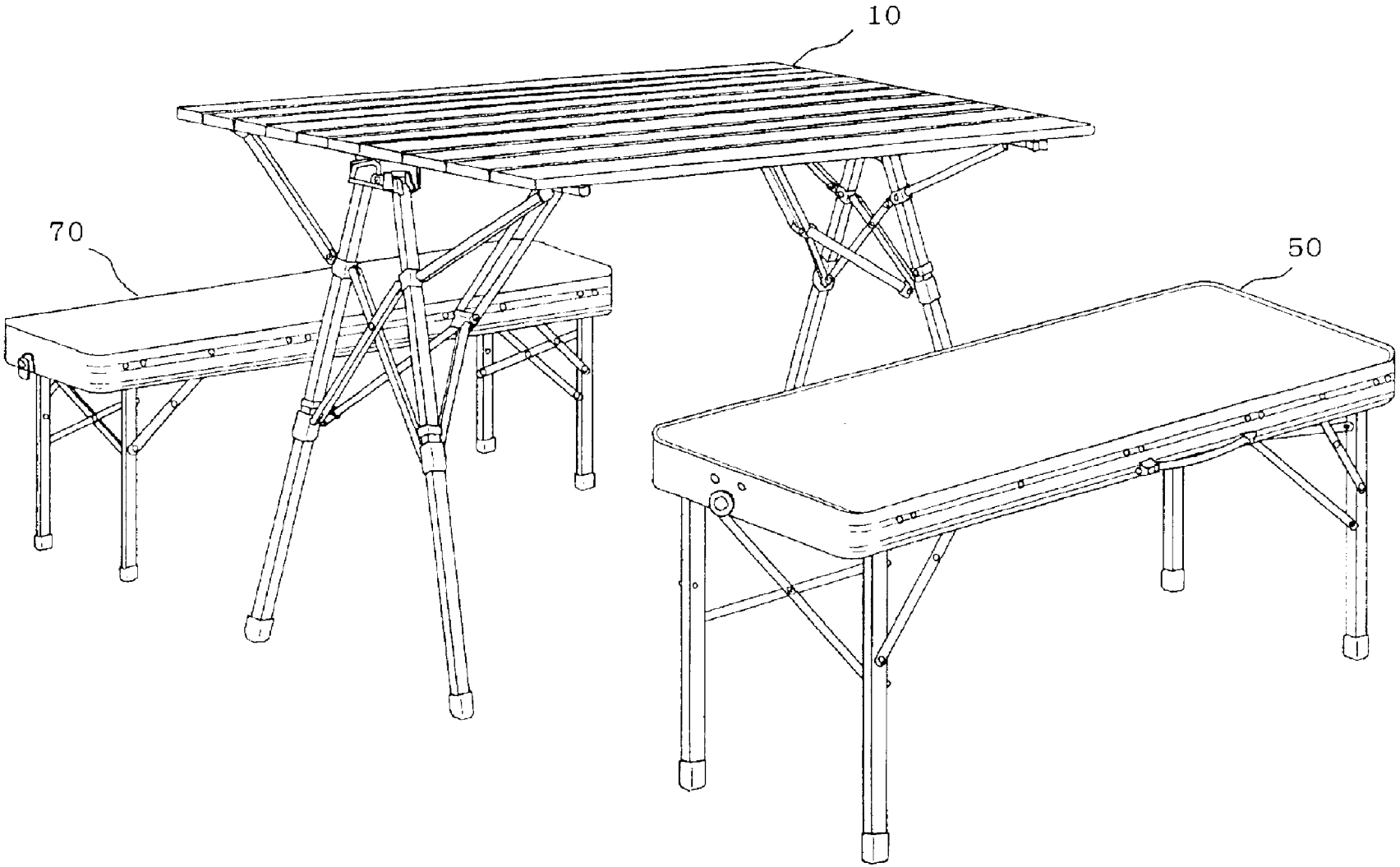
FIG. 19 is a perspective view of a set of outdoor table and chair according to another example of the present invention.

FIG. 19 shows a set of the outdoor table of FIG. 18 with chairs according to an example of the invention.

As described above, the outdoor table and chair set of this invention has a stable tabletop that has no support mechanisms on the underneath surface of the tabletop from the corners along two parallel sides to the middle portions, and it is also foldable. Moreover, the two outdoor chairs can be carried at the same time.

Also, when storing the table, the table-leg assemblies remain connected to the tabletop and do not need to be removed, so it is possible to prevent problems such as forgetting one of the legs at a campsite or the like.

The support mechanism of this invention uses a locking member that keeps the angle of the support mechanism at 181 to 183 degrees on the lower side.

The table and chair set can be manufactured more inexpensively, and also set up and folding of the table and chair set becomes easier.

What is claimed is:

1. An outdoor table comprising a tabletop having a plurality of slat members, a connection means to connect the slat members so as to deploy and fold the slat members in a deploying and folding direction, a pair of table-leg assemblies spaced apart from each other in a longitudinal direction of the slat members and each mounted to one or two of the slat members at the center in the deploying and folding direction and adapted to be folded underneath the tabletop, two pair of bars with tip end and base end arranged to be connected at the base end to the one or two slat members to which the pair of table-leg assemblies are mounted at a location near the ends in the lengthwise direction of the slat members such that each pair of bars can be rotated in opposite directions around the location between a state where the bars are directed almost in parallel to the slat members in the lengthwise direction and a state where the bars are directed orthogonal to the lengthwise direction of the slat members and in contact with the lower surface of the tabletop, joint members provided on two of the slat members located at the opposite ends of the tabletop such that the joint members are located near the opposite ends in the lengthwise direction of the two slat members on the lower surface thereof, respectively, and engagement structures provided on the tip ends of the bars so as to be engaged with the joint members of the slat members, respectively.

2. The outdoor table of claim 1, wherein the respective table-leg assemblies have a pair of legs having upper and lower ends, a link mechanism having link members being symmetrically connected to the pair of legs such that one end of one of the link members is fixed to one of the legs and the other end is slidably connected to the other of the legs while the one end of the other of the link members is fixed to the other of the legs and the other end is slidably connected to the one of the legs, and whereby the pair of legs can be rotated between a deployed state where the legs are almost in parallel to each other and a state where the upper ends of the legs are closer to each other and the lower ends are largely spaced from each other for use.

3. The outdoor table of claim 2, wherein a rotating member having a leg-rotation shaft and a leg-assembly rotation shaft is connected to the lower surface of the one or two slat members to which the table leg structure is connected, wherein the upper end of the respective legs is rotatably connected to the respective rotating member through the leg-rotation shaft orthogonal to the respective legs and in a deploying and folding plane of the legs, and wherein the respective rotating members are rotatably connected through the leg-assembly rotation shaft to the lower surface of the one or two slat members to which the table leg structure is connected, the leg-assembly rotation shaft being orthogonal to the leg-rotation shaft, wherein a support member is rotatably provided in the respective legs at a portion spaced from by a predetermined distance from the upper end of the respective legs, and wherein the support member has a tip end which is adapted to be abutted to and engaged with the outside end of the respective bars.

4. The outdoor table of claim 2, wherein a support structure comprising two link members connected to each other through a rotating shaft is provided, and wherein the support structure is rotatably connected at the lower end thereof to the rotating shaft of the link structure of the table-leg assembly and at the upper end thereof to the lower surface of the one or two slat members to which the table-leg assembly is connected, and wherein the support structure is moved between a stoppable extended state where a load from the tabletop is supported by the support structure when the table-leg assembly stands up, and a folded state where the table-leg assembly is folded, and whereby the stability of the tabletop is secured.

5. The outdoor table of claim 2, wherein one of the two support members of the support structure has a lock member fixed thereto and the other has an engagement structure formed therein to be engaged with the lock member, so that the two support members of the support structure are in an extended state with an angle of 181 to 183 degrees therebetween on the lower side when it is moved from a folded state over 180 degrees to the extended state, and locked in the extended state.

6. The outdoor table of claim 2, wherein the support structure is comprised of three link members connected to each other in a Y-shape and constructed such that two of the link members are connected to the link structure of the table-leg assembly on the sliding side thereof, while the other of the link members is connected to the one or two slat members to which the table leg structure is attached to the lower surface such that the two link members are connected rotatably to the other member, and whereby the support structure is moved between a stoppable extended state where a load from the tabletop is supported by the support structure when the table-leg assembly stands up, and a folded state where the table-leg assembly is folded, and whereby the stability of the tabletop is secured.

7. An outdoor table and chair set comprising a pair of outdoor chairs and an outdoor table of claim 1, the outdoor chairs comprising a seat having a seat surface with an outer edge depending downwards when in use, a pair of chair-leg assemblies which can be folded onto the lower side of the seat, and a fixing means for connecting the outdoor chairs to each other for fixing in a folded state with the seat surfaces facing outside and with the edges of the outdoor chairs facing to each other and in contact with each other, and the outdoor table being set into the internal space between the two outdoor chairs which are folded and fixed to each other.

8. An outdoor table comprising a tabletop having a plurality of slat members connected by a connection means so as to be deployed and folded, and a pair of table-leg assemblies each mounted to one or two in the middle of the slat members so as to be folded and set underneath the table top, the one or two of the slat members to which the table-leg assembly is mounted having two pairs of bars with tip end and base end being connected at the base end to the tabletop such that each pair of bars are rotated in the opposite directions and moved between the state where the bars are almost parallel to the lengthwise direction of the slat members and the state where the bars are orthogonal to the lengthwise direction, one pair of the bars connected at the portion to which the one of the table-leg assemblies are mounted, the other pair of the bars connected at the portion to which the other of the table-leg assemblies are mounted, two of the slat members located at the opposite ends of the tabletop when the slat members are deployed and having a lower surface on which a joint member is provided on the opposite lengthwise ends, the bars having an engagement structure near the tip end thereof to be engaged with the joint member, the table-leg assemblies comprising a pair of legs with upper and lower ends and a link mechanism having link members such that the upper end of one of the link members is fixed to one of the pair of legs and the lower end of the one of the link members is slidably mounted to the other of the pair of legs and that the upper end of the other of the link members is fixed to the other of the pair of legs and the lower end of the other of the link members is slidably mounted to the one of the pair of legs, so that the link members are mounted to the pair of legs in a symmetrical form, the legs being adapted to be moved between the closed state where the legs are closed in almost parallel to each other and the opened state where the upper ends of the pair of legs are closer to each other while the lower ends are largely spaced from each other for use, the upper end of the legs being provided with a rotating member and rotatably connected to the respective legs through a leg-rotation shaft located orthogonal to the legs and in the plane in which the legs are opened and closed, the rotating member being rotatably connected through a leg-assembly rotation shaft orthogonal to the leg-rotation shaft to the lower surface of the one or two slat members to which the table-leg assembly is mounted, the bars having at the outside end thereof a hook structure which is adapted to be manually released and automatically restored, the respective legs having a support member with a tip end rotatably mounted to a portion spaced from the upper end of the legs, the tip end of the support member having an engagement structure to be engaged with the hook structure, such that the hook structure is engaged with the support member and with the joint member of the tabletop, whereby the tabletop is stabilized.

9. The outdoor table of claim 8, wherein a support structure comprising two link members connected to each other through a rotating shaft is rotatably connected at one end of the respective link members to the rotating shaft of the link structure of the table-leg assembly and to the portion of the one or two members to which the table-leg assembly is mounted, whereby the support structure is moved between a stoppable extended state where a load from the tabletop is supported by the support structure when the table legs stand up, and a folded state where the table-leg assembly is folded, and whereby the stability of the tabletop is secured.

10. The outdoor table of claim 9, wherein one of the link members of the support structure has a lock member while the other has an engagement structure to be engaged with the lock member, and wherein the link members of the support structure are extended from the folded state to the extended state until the angle on the lower side between the link members becomes in the range of 181 to 183 degrees beyond 180 degrees and locked in the extended state.

11. The outdoor table of claim 8, wherein the support structure is comprised of three link members connected to each other in a Y-shape and constructed such that two of the link members are connected to the link mechanism of the table-leg assembly on the sliding side thereof while the other of the link members is connected to the one or two slat members to which the table leg structure is attached at the center area of the lower surface such that the two link members are connected rotatably to the other of the link members, and whereby the support structure is moved between a stoppable extended state where the load from the tabletop is supported by the support structure when the table-leg assembly stands up, and a folded state where the table-leg assembly is folded, and whereby the stability of the tabletop is secured.

12. An outdoor table and chair set comprising a pair of outdoor chairs and an outdoor table of claim 8, the outdoor chairs comprising a seat having a seat surface with an outer edge depending downwards when in use, a pair of chair-leg assemblies which can be folded onto the lower side of the seat, and a fixing means for connecting the outdoor chairs to each other for fixing in the folded state with the seat surfaces facing outside and with the edges facing to each other and in contact with each other, and the outdoor table being set into an internal space between the pair of outdoor chairs which are folded and fixed to each other.

13. An outdoor table comprising a tabletop having a plurality of slat members connected by a connection means so as to be deployed and folded, and a pair of table-leg assemblies each mounted to one or two in the middle of the slat members so as to be folded and set underneath the table top, the one or two of the slat members to which the table-leg assembly is mounted having two pairs of bars with tip end and base end and connected at the base end to the tabletop such that each pair of bars are rotated in the opposite directions and moved between the state where the bars are almost parallel to the lengthwise direction of the slat members and the state where the bars are orthogonal to the lengthwise direction, one pair of the bars connected at the portion to which the one of the table-leg assemblies are mounted, the other pair of the bars connected at the portion to which the other of the table-leg assemblies are mounted, two of the slat members located at the apposite ends of the tabletop when the slat members are deployed and having a lower surface on which a joint member is provided on the opposite lengthwise ends, the bars having an engagement structure near the tip end thereof to be engaged with the joint member, the table-leg assemblies comprising a pair of legs with upper and lower ends and a link mechanism having link members such that the upper end of one of the link members is fixed to one of the pair of legs and the lower end of the one of the link members is slidably mounted to the other of the pair of legs and that the upper end of the other of the link members is fixed to the other of the pair of legs and the lower end of the other of the link members is slidably mounted to the one of the pair of legs, so that the link members are mounted to the pair of legs in a symmetrical form, the legs being adapted to be moved between the closed state where the legs are closed in almost parallel to each other and the opened state where the upper ends of the pair of legs are closer to each other while the lower ends are largely spaced from each other for use, the upper end of the legs being provided with a rotating member and rotatably connected to the respective legs through a leg-rotation shaft located orthogonal to the legs and in a plane in which the legs are opened and closed, the rotating member being rotatably connected through a leg-assembly rotation shaft orthogonal to the leg-rotation shaft to the lower surface of the one or two slat members to which the table-leg assembly is mounted, the respective legs having a joint structure at a portion spaced from the upper end thereof, the joint structure having a projection in a spherical shape, a support member being mounted to the respective legs such that two continuous surfaces are formed in the support member to have a groove having a width enough to slidably receive the projection of the joint structure therein, and that the support member having one end rotatably mounted to the projection through the groove and the other end rotatably to a portion near the end of the bars through a rotating shaft, whereby the tabletop is stabilized by way of the support members and joint structure in the state where the legs are opened.

14. The outdoor table of claim 13, wherein a support structure comprising two link members connected to each other through a rotating shaft is rotatably connected at one end of the respective link members to the rotating shaft of the link structure of the table-leg assembly and to the portion of the one or two members to which the table-leg assembly is mounted, whereby the support structure is moved between a stoppable extended state where a load from the tabletop is supported by the support structure when the table less stand up, and a folded state where the table-leg assembly is folded, and whereby the stability of the tabletop is secured.

15. The outdoor table of claim 14, wherein one of the link members of the support structure has a lock member while the other has an engagement structure to be engaged with the lock member, and wherein the link members of the support structure are extended from a folded state to a extended state until the angle on the lower side between the link members becomes in the range of 181 to 183 degrees beyond 180 degrees and locked in the extended state.

16. The outdoor table of claim 13, wherein the support structure is comprised of three link members connected to each other in a Y-shape and constructed such that two of the link members are connected to the link mechanism of the table-leg assembly on the sliding side thereof while the other of the link members is connected to the one or two slat members to which the table leg structure is attached at the center area of the lower surface such that the two link members an connected rotatably to the other of the link members, and whereby the support structure is moved between a stoppable extended state where the load from the tabletop is supported by the support structure when the table-leg assembly stands up, and a folded state where the table-leg assembly is folded, and whereby the stability of the tabletop is secured.

17. An outdoor table and chair set comprising a pair of outdoor chairs and an outdoor table of claim 13, the outdoor chairs comprising a seat having a seat surface with an outer edge depending downwards when in use, a pair of chair-leg assemblies which can be folded onto the lower side of the seat, and a fixing means for connecting the outdoor chairs to each other for fixing in a folded state with the seat surfaces facing outside and with the edges facing to each other and in contact with each other, and the outdoor table being set into an internal space between the pair of outdoor chairs which are folded and fixed to each other.

* * * * *